US009032969B1

(12) United States Patent
Sinclair, Jr.

(10) Patent No.: US 9,032,969 B1
(45) Date of Patent: May 19, 2015

(54) METHOD AND APPARATUS FOR MAKING A CUSTOM MADE CIGAR USING RESEALABLE PACKAGING UNIT OR POUCH HAVING MULTIPLE CIGAR WRAPPERS

(75) Inventor: Daniel S. Sinclair, Jr., Mandeville, LA (US)

(73) Assignee: Durfort Holdings, S.A., Panama, Rep. de Panama (PA)

( * ) Notice: Subject to any disclaimer, the term of this patent is extended or adjusted under 35 U.S.C. 154(b) by 839 days.

(21) Appl. No.: 13/296,335

(22) Filed: Nov. 15, 2011

Related U.S. Application Data

(60) Provisional application No. 61/413,534, filed on Nov. 15, 2010.

(51) Int. Cl.
*A24F 15/00* (2006.01)
*B65D 17/00* (2006.01)

(52) U.S. Cl.
CPC ..... *A24F 15/00* (2013.01); *B65D 17/00* (2013.01)

(58) Field of Classification Search
None
See application file for complete search history.

(56) References Cited

U.S. PATENT DOCUMENTS

2012/0042883 A1* 2/2012 Hillard ..... 131/58

* cited by examiner

*Primary Examiner* — Michael J Felton
(74) *Attorney, Agent, or Firm* — Brett A. North; Garvey, Smith, Nehrbass and North, L.L.C.

(57) ABSTRACT

A pouch with multiple tear areas is provided. In one embodiment instructions are provided for resealing with heat. In one embodiment a zip-lock type reseal can be used in place of one of the multiple tear areas.

23 Claims, 5 Drawing Sheets

FIG. 6
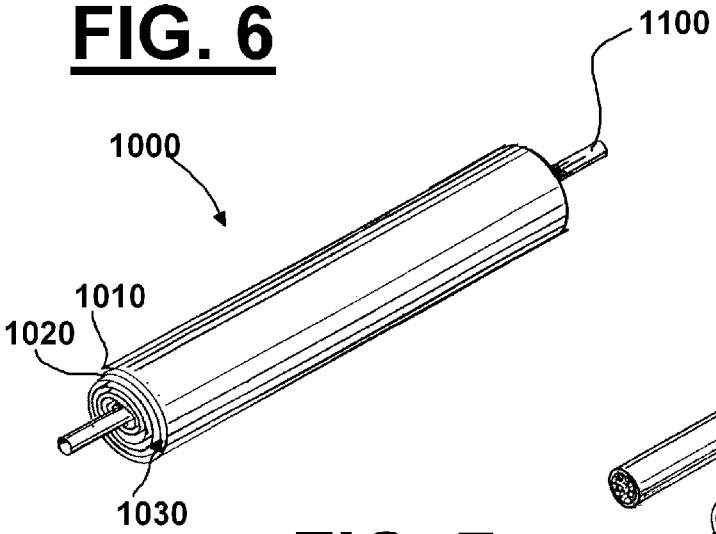
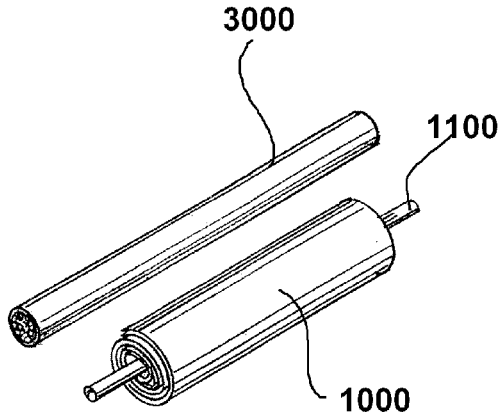
FIG. 7
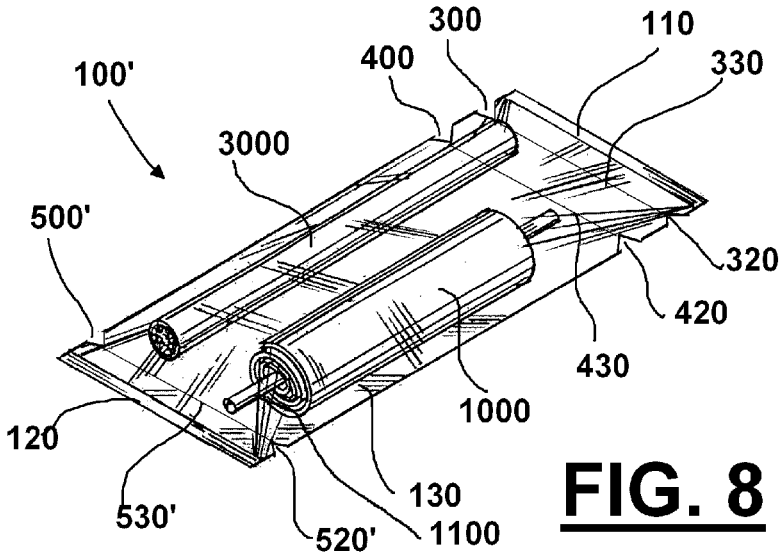
FIG. 8

METHOD AND APPARATUS FOR MAKING A CUSTOM MADE CIGAR USING RESEALABLE PACKAGING UNIT OR POUCH HAVING MULTIPLE CIGAR WRAPPERS

CROSS-REFERENCE TO RELATED APPLICATIONS

This is a non-provisional of U.S. Patent Application Ser. No. 61/413,534, filed Nov. 15, 2010, which application is incorporated herein by reference and to which priority is claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND

As the smoking market is increasingly requiring greater numbers of cigar wrappers or smokable units to be sold to consumers in single pouches. Conventionally available packaging for such cigar wrappers do not provide the user with the flexibility of quickly and easily opening the pouch to retrieve a tobacco product or cigar wrapper and then reseal the pouch preventing the tobacco products or cigar wrappers remaining in the pouch from becoming dried out.

Zip lock sealing elements have been placed in prior art pouches however these sealing elements have been found to be difficult to open.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY

One embodiment provides an improved method of constructing a cigarette or cigar.

One embodiment relates to an improved method of fabricating multiple cigarettes or cigars using an improved packaging.

In one embodiment a pouch with multiple tearing areas is provided.

In one embodiment is provided on the pouch instructions for using the multiple tearing areas.

In one embodiment is provided on the pouch instructions for resealing the pouch using heat after opening the pouch using one of the multiple tearing areas.

In one embodiment, the method includes the steps of (a) provide a plurality of cigar wrappers packaged in a pouch having a plurality of tear areas disposed on one end of the packaging;

(b) opening packaging using a first tear area, and a first cigar wrapper being removed from the packaging, (c) resealing the packaging below the first tear area;

(d) forming a cigar or cigarette by the addition of tobacco filler to the first cigar wrapper, and rolling the cigar wrapper around the filler.

The above method with the following additional steps:

(e) opening the packaging a second time using a second tear area, and a second cigar wrapper being removed from packaging; and (f) forming a cigar or cigarette by the addition of tobacco filler to the second cigar wrapper, and rolling the cigar wrapper around the filler.

The above method with the following additional steps:

(g) resealing the packaging below the second tear area;

(h) opening the packaging a third time using a third tear area, and a third cigar wrapper being removed from packaging; and (i) forming a cigar or cigarette by the addition of tobacco filler to the third cigar wrapper, and rolling the cigar wrapper around the filler.

The above method with the following additional steps:

(j) opening the packaging a fourth time using a fourth tear area, and a fourth cigar wrapper being removed from packaging; and (k) forming a cigar or cigarette by the addition of tobacco filler to the fourth cigar wrapper, and rolling the cigar wrapper around the filler.

In various embodiments a resealable zip lock system can replace the first, second, third, and/or fourth tear area.

In one embodiment is provided a smokable apparatus comprising a first sheet and second sheets forming a pre-rolled cigar wrappers. The first and second sheets of material can be comprised of tobacco, homogenized tobacco and/or natural leaf materials. First and second sheets of material can be comprised of tobacco, homogenized tobacco and/or natural leaf materials such as plant leaves (e.g., banana, palm leaves, etc.) and the like.

The sheets of material are packaged for sale. The packaging can include instructions regarding how to open and/or reseal the packaging using one of the first, second, etc. tear areas.

In one embodiment flavoring and/or moisture to the first sheet of flammable material (by methods known to one skilled in the art such as spraying a mist, brushing or dipping the sheets of flammable material into a vat of hydrant or flavor mixture, etc.) may be done at any time prior to packaging.

In one embodiment each cone or tube can have proximal and distal end portions, each having an opening.

In one embodiment the method can include nesting of one cone or tube inside the other cone or tube.

In one embodiment, the nested cones or tubes are partially filled.

In one embodiment, the packaging can be cylindrically shaped.

In one embodiment, the packaging can be conically shaped.

In various embodiments the pouches with the one or more tear areas can be empty of tobacco products. In these embodiments the pouches would be completed some time in the future. The pouches could be unsealed with the one or more tear areas. In such a case a tobacco manufacturer could take the unsealed pouches, insert one or more tobacco products inside, and then seal the pouch (sealing can be accomplished by application of heat). In another case the empty pouches with the one or more tear areas can be marketed to retail establishments (such as tobacco shops), who themselves use the pouches to package one or more tobacco products, and resell the packaged tobacco products to ultimate consumers.

In even another case the empty pouches with the one or more tear areas can be marketed to consumers who themselves use the pouches to package one or more tobacco products. Here, the consumer, after filling the pouch with one or more tobacco products, can seal the pouch by application of heat (such as by the flame of a lighter). The consumer can then access the one or more tobacco products by using one of the tear areas, and then reseal the pouch by application of heat.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 6 is a perspective view of a sample tobacco product which can be packaged for sale in the pouch of FIG. 1, where this sample tobacco product includes a plurality of smokable sheets wrapped around a form mandrel or straw.

FIG. 7 is a perspective view of a plurality of sample tobacco products which can be packaged for sale in the pouch of FIG. 1, where one of the products is a finished cigarette or cigar, and the second includes a plurality of smokable sheets wrapped around a form mandrel or straw.

FIG. 8 is a perspective view of a pouch with multiple tear areas in which is packaged for sale two sets of tobacco products, where one set includes a finished cigarette or cigar, and the other set includes a single or a plurality of smokable sheets wrapped around a form mandrel or straw.

DETAILED DESCRIPTION

Figure 1:
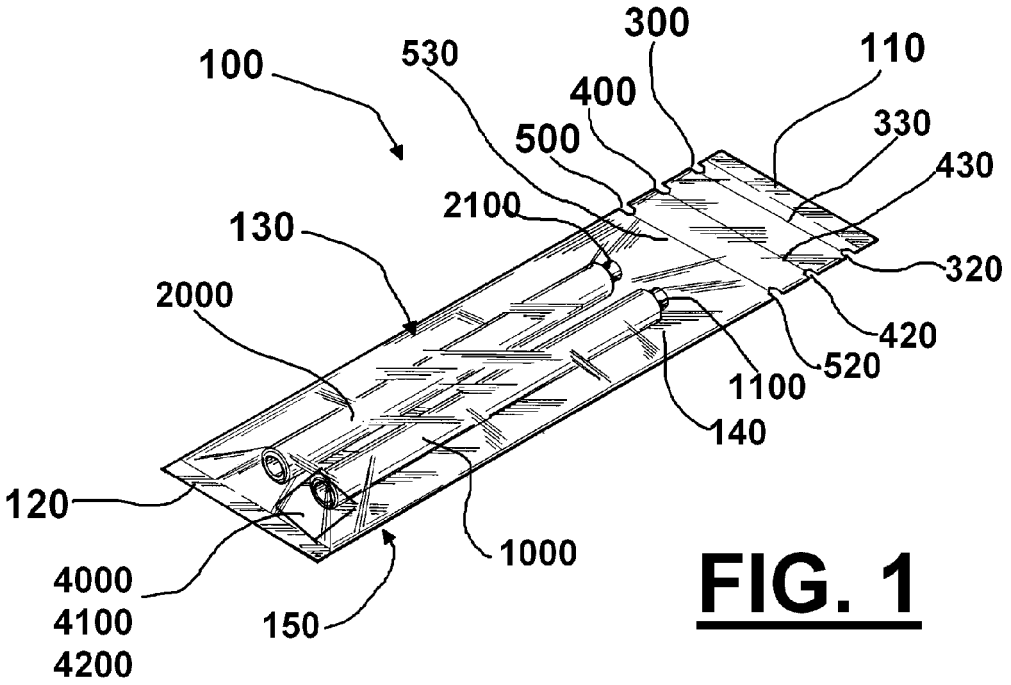
FIG. 1 is a perspective view of a pouch with multiple tear areas in which is packaged for sale two sets of tobacco products, where each set includes a single or a plurality of smokable sheets wrapped around a form mandrel or straw.

FIG. 1 is a perspective view of a pouch 100 with multiple tear areas 300, 400, 500 in which is packaged for sale two sets of tobacco products 1000, 2000, where each set 1000, 2000 includes a single 1010 or a plurality of smokable sheets 1010, 1020 wrapped around a form mandrel or straw 1100.

Tear area 300 can include a notch on first side 310, along with a notch on second side 320. One or both of the notches can be tear slits. A tear line 330 can be included and can span from first side 310 to second side 320. Tear line can be a marked line, or can be a line of perforations to assist in tearing. If perforated, the perforations should be constructed such that the perforations are substantially impermeable with respect to the interior 134 of pouch. In one alternative the tear line can be an etched portion or portion of reduced thickness to facilitate tearing about the tear line. In one embodiment the notch or slit can be omitted from one of the sides (310 or 320).

Tear area 400 can include a notch on first side 410, along with a notch on second side 420. One or both of the notches can be tear slits. A tear line 430 can be included and can span from first side 410 to second side 420. Tear line can be a marked line, or can be a line of perforations to assist in tearing. If perforated, the perforations should be constructed such that the perforations are substantially impermeable with respect to the interior 134 of pouch. In one alternative the tear line can be an etched portion or portion of reduced thickness to facilitate tearing about the tear line. In one embodiment the notch or slit can be omitted from one of the sides (410 or 420).

Tear area 500 can include a notch on first side 510, along with a notch on second side 520. One or both of the notches can be tear slits. A tear line 530 can be included and can span from first side 510 to second side 520. Tear line can be a marked line, or can be a line of perforations to assist in tearing. If perforated, the perforations should be constructed such that the perforations are substantially impermeable with respect to the interior 134 of pouch. In one alternative the tear line can be an etched portion or portion of reduced thickness to facilitate tearing about the tear line. In one embodiment the notch or slit can be omitted from one of the sides (510 or 520).

In one embodiment the notch or slit can alternate from sides between different tear areas (300, 400, and/or 500). For example, tear area 300 can include notch or slit on side 310, but not on side 320; and tear area 400 can include notch or slit on side 420, but not on side 410; and tear area 500 can include notch or slit on side 510, but not on side 520.

In another embodiment the notch or slit can alternate from sides between different tear areas (300, 400, and/or 500). For example, tear area 300 can include notch or slit on side 320, but not on side 310; and tear area 400 can include notch or slit on side 410, but not on side 420; and tear area 500 can include notch or slit on side 520, but not on side 510.

In another embodiment the notch or slit can alternate from sides between one of the tear areas (300, 400, and/or 500). For example, tear area 300 can include notch or slit on side 310, but not on side 320; and tear area 400 can include notches or slits on both sides 410 and 420; and tear area 500 can include notches or slits on both sides 510 and 520.

In another embodiment the notch or slit can alternate from sides between one of the tear areas (300, 400, and/or 500). For example, tear area 400 can include notch or slit on side 410, but not on side 420; and tear area 300 can include notches or slits on both sides 310 and 320; and tear area 500 can include notches or slits on both sides 510 and 520.

In another embodiment the notch or slit can alternate from sides between one of the tear areas (300, 400, and/or 500). For example, tear area 500 can include notch or slit on side 510, but not on side 520; and tear area 300 can include notches or slits on both sides 310 and 320; and tear area 400 can include notches or slits on both sides 410 and 420.

With alternative notches the user would open the pouch in the chosen tear area (300,400, and/or 500) from a notched or slitted side.

In one embodiment tear area 300 is closest to first end 110, and tear area 400 is second closest to first end, and tear area 500 is relatively the farthest from first end 110. In one embodiment year area 400 is between tear area 300 and tear area 500.

In one embodiment tear area 500 is omitted.

In one embodiment one of the tear areas (300, 400, or 500) are replaced with a zip-lock resealable closing mechanism. In one embodiment the zip lock closing mechanism is open when pouch 100 is offered for sale to the ultimate consumer. In one embodiment the zip lock resealable mechanism is located in the position of tear area 400.

Figure 2:
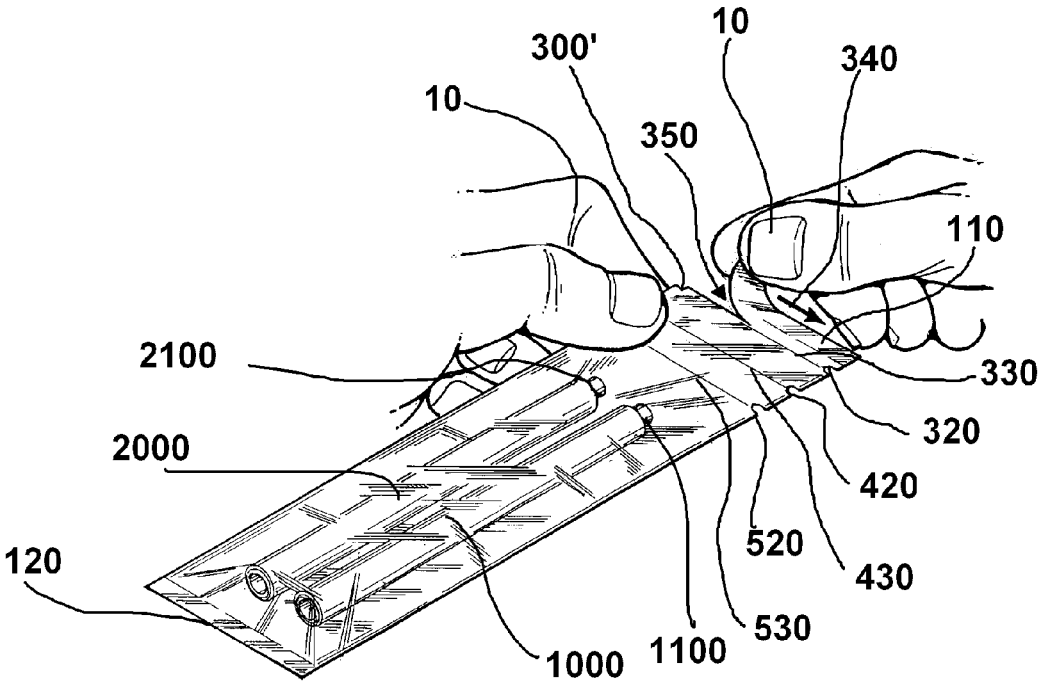
FIG. 2 is a perspective view of the pouch of FIG. 1 being opened using one of the tear areas to provide access to the two sets of tobacco products located in the interior of the pouch.

FIG. 2 is a perspective view of the pouch 100 being opened using one of the tear areas 300, 400, 500 to provide access to the two sets of tobacco products 1000, 2000 located in the interior 130 of the pouch 100.

In FIG. 2 tear area 300 is being used to tear open and gain access to the interior 134 of pouch 100. Arrow 350 schematically indicates the application of force and direction of tear along tear line 310. After tearing open remaining of the notch on tear area 300 is partial notch 300'.

Figure 3:
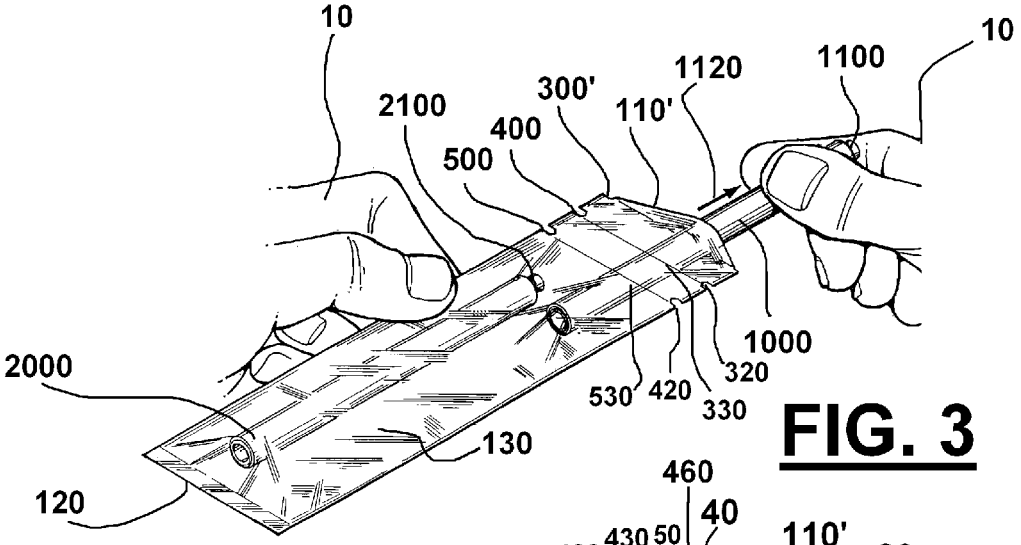
FIG. 3 is a perspective view of the pouch of FIG. 1, after being opened, showing a user removing one of the set of tobacco products located in the interior of the pouch.

FIG. 3 is a perspective view of pouch 100, after being opened via tear area 300, showing a user 10 removing one of the set of tobacco products located in the interior 134 of the pouch.

Arrow 1120 schematically indicates the removal of tobacco product 1000. Tobacco product 1000 can include smokable sheets 1010 and 1020, one of which can be removed from mandrel 1100, filled with a tobacco filler and rolled to form a custom cigar or cigarette. Either one or both of smokable sheets 1010,1020 can be used to make the custom cigar or cigarette. In this case none of tobacco product 1000 was inserted back into interior 134 of pouch 100. In an alternative embodiment, sheet 1010 is removed from tobacco product 1000, and sheet 1020 wrapped around straw 1100 is inserted back into pouch 100 (making this tobacco product 1000').

Figure 4:
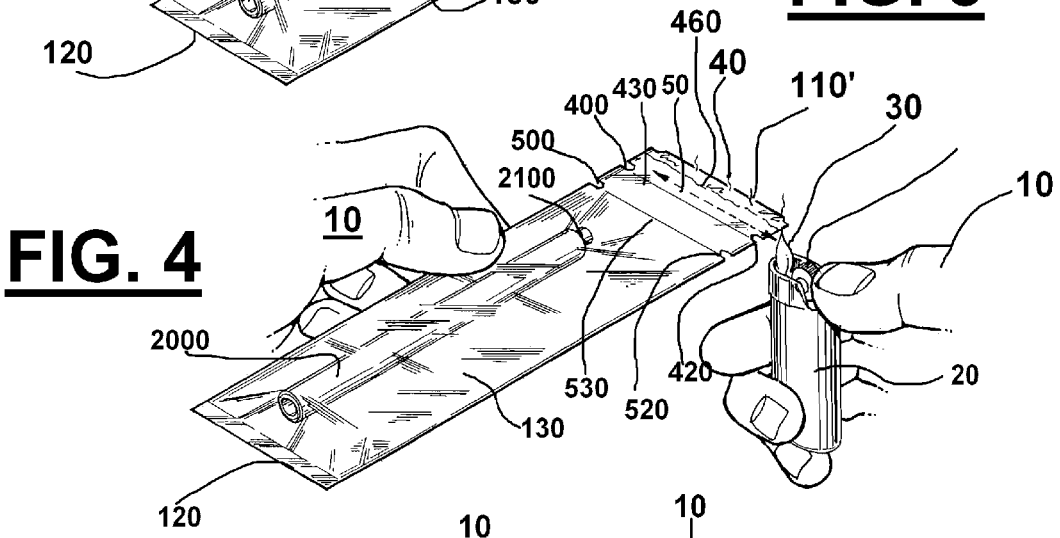
FIG. 4 is a perspective view of the pouch of FIG. 1 being resealed by the user with one of the sets of tobacco products remaining in the interior of the pouch, for future use.

FIG. 4 is a perspective view of pouch 100 being resealed by user 10 with one of the sets of tobacco products 2000 remaining in the interior 134 of the pouch 100, for future use. To reseal pouch 100, a lighter 20 with flame 30 can be used. Here flame 30 can be applied to pouch 100 between tearing area 400 and now shortened first end 110' to seal the two faces (front 140 and rear 150) of pouch together (e.g., by melting these two faces). Arrows 50 schematically indicates the application of heat via flame 30 applying heat 40 to faces 140 and 150 to melt or fuse these faces together (along arrows 50) thereby sealing the interior 134 of pouch 100 (via resealed portion 460) and preventing remaining tobacco products (e.g., 2000) from drying out.

After resealing, when desired, the tobacco product 2000 remaining in sealed pouch 100 can be accessed by opening tear area 400 (or tear area 500).

Figure 5:
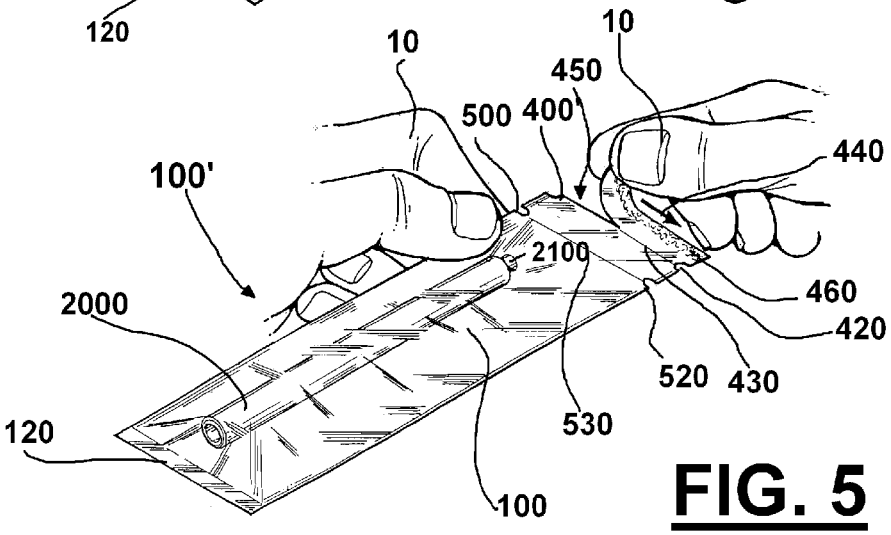
FIG. 5 is a perspective view of the pouch of FIG. 4 being opened using one of the tear areas to provide access to the tobacco products located in the interior of the pouch.

FIG. 5 is a perspective view of the pouch 100' being opened using one of the tear areas 400 or 500 to provide access to the tobacco products located in the interior of the pouch (in this case tobacco product 2000).

In FIG. 5 tear area 400 is being used to tear open and gain access to the interior 134 of pouch 100'. Arrow 450 schematically indicates the application of force and direction of tear along tear line 410. After tearing open remaining of the notch on tear area 400 is partial notch 400'. After being opened via tear area 400, a user 10 can remove tobacco product 2000 located in the interior 134 of the pouch, and form a custom cigar or cigarette.

FIG. 6 is a perspective view of a sample tobacco product 1000 which can be packaged for sale in pouch 100, where this sample tobacco product 1000 includes a plurality of smokable sheets 1010, 1020 wrapped around a form mandrel or straw 1100. Smokable sheets can be sheets comprised of smokable materials chosen from any combination of the following materials: natural leaf, homogenized tobacco, pipe tobacco, different types of flavored tobacco, cellulose (clear, opaque, or colored), paper, tea leaves, kanna, blue lotus, *salvia, salvia* eivinorm, wild dagga, kratom, herbal non-tobacco, Celandine Poppy, Mugwort, Purple Lavender Flowers, Coltsfoot Leaf, Ginger root, California Poppy, Sinicuichi, St. John's Wort, Capillarius herba, Yerba Lenna Yesca, Calea Zacatechichi, Leonurus Sibericus Flowers, Wild Dagga Flowers, Klip Dagga Leaf, Damiana, Hookah, *Hemia salicifolia*, Kava Kava, *Avena Sativa*, scotch broom topps, Valarian, capillarius, herba, Wild clip dagga, *Leonurus sibiricus*, Kanna, Sinicuichi, and/or *lactuca virosa*.

In various embodiments the interleaved sheets are comprised of smokable materials chosen from any combination of the following materials: natural leaf, homogenized tobacco paper, pipe tobacco, different types of flavored tobacco, cellulose (clear, opaque, or colored), paper, tea leaves, kanna, blue lotus, *salvia, salvia* eivinorm, wild dagga, kratom, herbal non-tobacco, Celandine Poppy, Mugwort, Purple Lavender Flowers, Coltsfoot Leaf, Ginger root, California Poppy, Sinicuichi, St. John's Wort, Capillarius herba, Yerba Lenna Yesca, Calea Zacatechichi, Leonurus Sibericus Flowers, Wild Dagga Flowers, Klip Dagga Leaf, Damiana, Hookah, *Hemia salicifolia*, Kava Kava, *Avena Sativa*, scotch broom topps, Valarian, capillarius, herba, Wild clip dagga, *Leonurus sibiricus*, Kanna, Sinicuichi, and/or *lactuca virosa*.

Each smokable sheet 1010, 1020, etc. can include an intermediate moisture barrier 1030 (such as cellophane, plastic, foil, wax paper, and/or other materials which can inhibit moisture loss). Also alternatively, an intermediate (and unattached) sheet 1030 can be placed between one or more sheets 1010, 1020, etc. to prevent the sheets from sticking to each other and to themselves. These intermediate sheets can be of the same construction as moisture barrier. The intermediate sheets would preferably be about the same size as sheets 1010, 1020, etc., but would not be connected to such sheets. These intermediate sheets 1030 would assist in the removal of sheets 1010, 1020, etc. from tobacco product 1000 and straw 1100. Additionally, this intermediate sheet 1030 would inhibit moisture loss from tobacco product 1000. When making the custom cigar or cigarette, the intermediate sheet 1030 would be removed and discarded after sheet 1010 was removed from tobacco product 1000. In one embodiment, if an intermediate sheet 1030 is used, it should be removed from sheets 1010 and/or 1020 because this intermediate sheet 1030 is not smokable.

FIG. 7 is a perspective view of a plurality of sample tobacco products 1000, 3000 which can be packaged for sale in pouch 100, where one of the products 3000 is a finished cigarette or cigar, and the second 1000 includes a plurality of smokable sheets 1010,1020 wrapped around a form mandrel or straw 1100 (similar to tobacco product 100 in FIG. 6).

FIG. 8 is a perspective view of a pouch 100" with multiple tear areas 300, 400, 500' in which is packaged for sale two sets of tobacco products 1000, 3000, where one set 3000 includes a finished cigarette or cigar, and the other set 1000 includes a single or a plurality of smokable sheets 1010, 1020 wrapped around a form mandrel or straw 1100.

In FIG. 8, tear area 500' is now spaced closer to end 120 of pouch 100' than to end 110, with tear areas 300 and 400 both spaced closer to end 110. Configuring tear area 500' to be spaced closer to end 120 allows the user to choose when end (110 or 120) of pouch 100' can be opened. Opening and heat sealing can be accomplished as substantially before. In one embodiment another tear area 600 can be spaced closed to tear area 500'.

Those skilled in the art will understand that various materials for the pouches can be used which include, but are not limited to, Low & High Density Polyethylene with EVA additive, Linear Low Density Poly, Polypropylene, Orientated Polypropylene, Cast Polypropylene, PVC, Polyester, Vaper Barrier packaging, Moisture Barrier packaging, Laminated packaging, Shrink film, Stretch Film, Foil Films (which can be translucent or opaque), Metalized Film, Cellophane, and Polyethylene Terephthalat. In addition to an "EVA" additive a barrier foil lamination can be used being either coated or metallized. The packaging, whether plastic, aluminum, or glass, keeps moisture in or dramatically slows down moisture loss from the sets of the tobacco products such as the pre-rolled sheet(s). It is preferable that the wrapping material have adequate moisture resistant properties so that the set of pre-rolled sheet(s) does not dry out before use by consumers.

The pouches can themselves be packaged in any appropriate manner. For example, they can be individually packaged in a bag or box. The box itself can be covered by a wrapper and include a window for viewing the contents.

Figure 9:
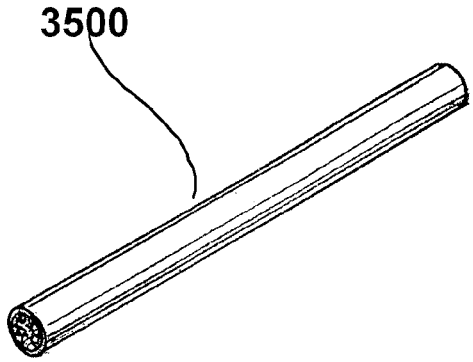
FIG. 9 is a finished cigar or cigarette either pulled from the pouch of FIG. 1 or constructed from a tobacco product pulled from the pouch of FIG. 1.

FIG. 9 is a finished cigar or cigarette 3500 either pulled from pouch 100 or constructed from a tobacco product 1000 pulled from pouch 100.

Figure 10:
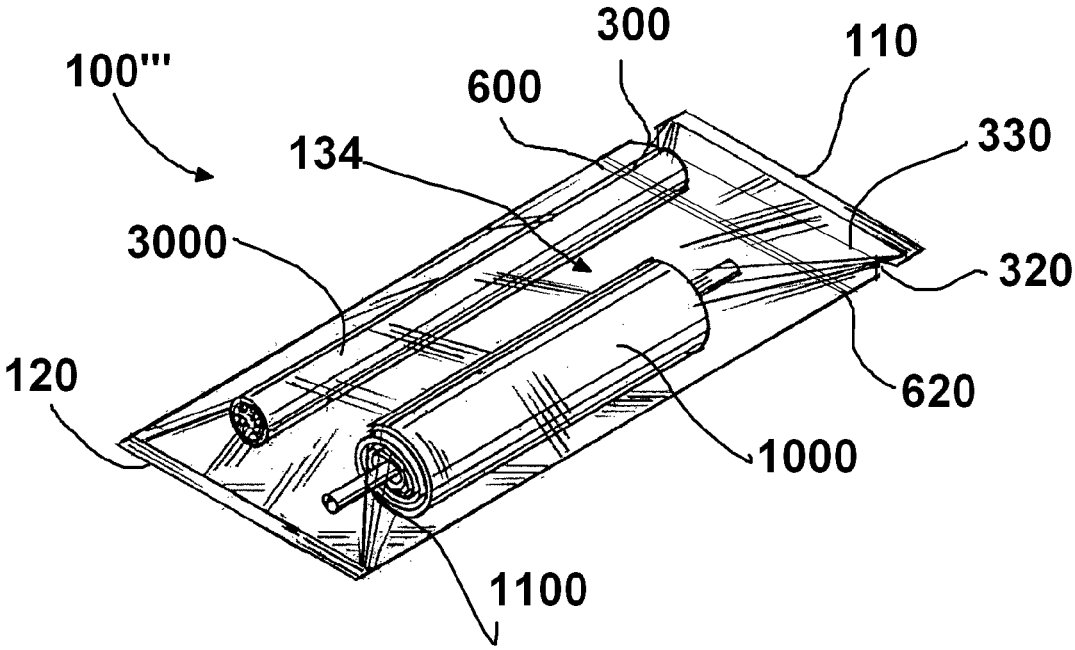
FIG. 10 is an alternative pouch having a tear area along with a zip lock sealing area located next to the tear area wherein the tear area is between the first end and the zip lock sealing area.

FIG. 10 is an alternative pouch 100''' having a tear area 300 along with a zip lock sealing element 600 located in the interior 134 of pouch 100''', next to the tear area 300, wherein the tear area 300 is between the first end 110 and the zip lock sealing element 600.

Figure 11:
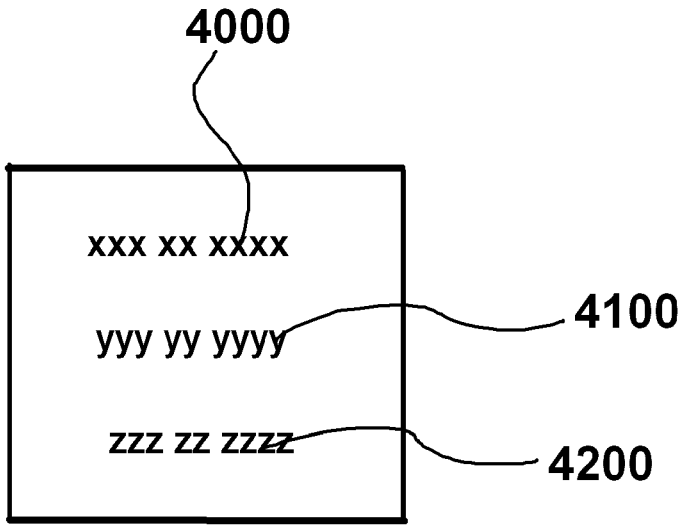
FIG. 11 is a sample set of instructions which can include instructions to open by tearing, instructions to reseal by application of heat, and instructions to reseal by use of a zip lock sealing element.

FIG. 11 is a sample set of instructions which can include instructions to open by tearing, instructions to reseal by application of heat, and instructions to reseal by use of a zip lock sealing element.

Instructions 4000 for opening pouch 100 using tear area 300, 400, and/or 500 can be placed on pouch 100.

Instructions 4100 for resealing pouch 100 with application of heat can be placed on pouch 100.

Instructions 4200 for resealing pouch 100 with zip lock be placed on pouch 100.

In various embodiment packaged in pouch 100 can be any combination of one or more of the following tobacco products: cigar(s), tobacco filler material, pipe tobacco, tubes, cones, paper cones, tobacco cones, and/or snuff.

Method

In one embodiment, the method includes the steps of:

(a) provide a plurality of cigar wrappers packaged in a pouch 100 having a plurality of tear areas 300, 400 disposed on one end 110 of the pouch 100;

(b) opening pouch using a first tear area 300, and a first cigar wrapper 1000 being removed from the pouch 100, (c) resealing the pouch 100 between the second tear area 400 and the end 110' of the pouch 100;

(d) forming a cigar or cigarette 3500 by the addition of tobacco filler to the first cigar wrapper 1000, and rolling the cigar wrapper around the filler.

The above method with the following additional steps:

(e) opening the pouch 100 a second time using a second tear area 400, and a second cigar wrapper 2000 being removed from the pouch 100; and (f) forming a cigar or cigarette 3500' by the addition of tobacco filler to the second cigar wrapper 2000, and rolling the cigar wrapper 2000 around the filler.

The above method with the following additional steps:

(g) resealing the pouch 100 between the third tear area 500 and the end 110" of the pouch 100;

(h) opening the pouch a third time using a third tear area 500, and a third cigar wrapper 2000' being removed from the pouch 100; and (i) forming a cigar or cigarette 3500" by the addition of tobacco filler to the third cigar wrapper 2000', and rolling the cigar wrapper 2000' around the filler.

In any of the above methods instructions 4000 and/or 4100 can be provided. In other embodiments instructions are printed on the pouch 100.

The following is a list of reference numerals used in this application.

LIST OF REFERENCE NUMERALS

| Reference Number | Description |
|---|---|
| 10 | user |
| 20 | lighter |
| 30 | flame |
| 40 | heat |
| 50 | arrow |
| 100 | pouch |
| 110 | first end |
| 120 | second end |
| 130 | interior space |
| 140 | front face |
| 150 | rear face |
| 300 | first tear area |
| 310 | first side |
| 320 | second side |
| 330 | tear line (area of reduced thickness) |
| 340 | arrow indicating direction of tear |
| 350 | torn portion |
| 400 | second tear area |
| 420 | second side |
| 430 | tear line (area of reduced thickness) |
| 440 | arrow indicating direction of tear |
| 450 | torn portion |
| 460 | resealed portion (melted) |
| 500 | third tear area |
| 520 | second side |
| 530 | tear line (area of reduced thickness) |
| 540 | arrow indicating direction of tear |
| 550 | torn portion |
| 560 | resealed portion (melted) |
| 1000 | first cigar wrapper or wrappers |
| 1010 | first sheet |
| 1020 | second sheet |
| 1030 | intermediate sheet |
| 1100 | form mandrel or support straw |
| 1120 | arrow |
| 2000 | second cigar wrapper or wrappers |
| 2100 | form mandrel or support straw |
| 3000 | finished tobacco product |
| 3500 | custom made cigar or cigarette |
| 4000 | opening by tear |
| 4100 | resealing with heat application |
| 4200 | resealing with zip lock resealable system |

All measurements disclosed herein are at standard temperature and pressure, at sea level on Earth, unless indicated otherwise. All materials used or intended to be used in a human being are biocompatible, unless indicated otherwise.

The foregoing description of presently preferred and other aspects of this invention has been presented by way of illustration and example. It does not present, nor is it intended to present, an exhaustive catalog of all structural and procedural forms by which the invention can be embodied. Variations upon and alterations of the described structures and procedures can be pursued without departing from the fair substance and scope of the invention consistent with the foregoing descriptions, and the following claims which are to be read and interpreted liberally in the context of the state of the art from which this invention has advanced.

The invention claimed is:

1. A tobacco product offered commercially for sale comprising:

(a) a plurality of tobacco products;

(b) a pouch containing the plurality of tobacco products;

(c) the pouch having multiple tear areas.

2. The tobacco product of claim 1, wherein the pouch has two tear areas.

3. The tobacco product of claim 1, wherein the pouch has three tear areas.

4. The tobacco product of claim 1, wherein the pouch has printed thereon instructions on how to open the pouch using one of the tear areas.

5. The tobacco product of claim 1, wherein the pouch has printed thereon instructions on how to apply heat to seal the pouch after opening the pouch using one of the tear areas.

6. The tobacco product of claim 5, wherein the instructions reference a lighter to use as the heat source.

7. The tobacco product of claim 5, wherein the instructions reference that the tear area closest to the end of the pouch should first be used to open the pouch.

8. The tobacco product of claim 1, wherein the pouch includes a zip lock sealing element.

9. The tobacco product of claim 1, wherein the zip lock sealing element is not sealed when the packaging is sealed before any of the tearing areas is used.

10. The tobacco product of claim 1, wherein the zip lock sealing element is positioned between two of the tearing areas.

11. A method of preparing a custom cigar comprising the steps of:

(a) providing a plurality of cigar wrappers packaged in a pouch 100 offered for sale commercially having a plurality of tear areas 300, 400 disposed on one end 110 of the pouch 100;

(b) opening pouch using a first tear area 300, and a first cigar wrapper 1000 being removed from the pouch 100, (c) resealing the pouch 100 between the second tear area 400 and the end 110' of the pouch 100;

(d) forming a cigar or cigarette 3500 by the addition of tobacco filler to the first cigar wrapper 1000, and rolling the cigar wrapper around the filler.

12. The method of claim 11, further comprising the following additional steps of:

(e) opening the pouch 100 a second time using a second tear area 400, and a second cigar wrapper 2000 being removed from the pouch 100; and (f) forming a cigar or cigarette 3500' by the addition of tobacco filler to the second cigar wrapper 2000, and rolling the cigar wrapper 2000 around the filler.

13. The method of claim 12, further comprising the following additional steps of:

(g) resealing the pouch 100 between the third tear area 500 and the end 110" of the pouch 100; and (h) opening the pouch a third time using a third tear area 500, and a third cigar.

14. The method of claim 11, wherein the pouch in step "a" includes a plurality of tobacco products.

15. The method of claim 11, wherein the pouch has two tear areas.

16. The method of claim 11, wherein the pouch in step "a" includes has three tear areas.

17. The method of claim 11, wherein the pouch in step "a" includes instructions printed thereon instructions on how to open the pouch using one of the tear areas.

18. The method of claim 11, wherein the pouch in step "a" has printed thereon instructions on how to apply heat to seal the pouch after opening the pouch using one of the tear areas.

19. The method of claim 18, wherein the pouch includes the instructions referencing the use of a lighter as the heat source.

20. The method of claim 11, wherein the pouch in step "a" includes instructions referencing that the tear area closest to the end of the pouch should first be used to open the pouch in step "b".

21. The method of claim 11, wherein the pouch in step "a" includes a zip lock sealing element.

22. The method of claim 21, wherein the zip lock sealing element is not sealed during step "a" and before step "b".

23. The method of claim 21, wherein the zip lock sealing element is positioned between two of the tearing areas.

* * * * *